United States Patent [19]

Davidson

[11] 4,179,826

[45] Dec. 25, 1979

[54] FOOT CUSHIONING DEVICE

[76] Inventor: Murray R. Davidson, 5702 N. 19th Ave., Phoenix, Ariz. 85015

[21] Appl. No.: 859,123

[22] Filed: Dec. 9, 1977

[51] Int. Cl.[2] ..... A43B 7/32; A43B 21/32

[52] U.S. Cl. ..... 36/69; 36/37; 36/71; 36/129

[58] Field of Search ..... 36/69, 37, 71, 129; 128/581, 614

[56] References Cited

U.S. PATENT DOCUMENTS

| | | | |
|---|---|---|---|
| 74,912 | 2/1868 | Hadley | 36/37 |
| 532,429 | 1/1895 | Rogers | 36/37 X |
| 558,345 | 4/1896 | Bowen | 36/37 |
| 1,056,957 | 3/1913 | Strootman | 36/37 |
| 1,128,220 | 2/1915 | Bullard | 36/37 |
| 1,299,983 | 4/1919 | Martyn et al. | 36/37 |
| 1,559,532 | 10/1925 | Smith | 36/37 X |
| 2,119,807 | 6/1938 | Farley | 36/37 X |
| 2,598,782 | 6/1952 | Gillis | 36/37 X |
| 3,237,319 | 3/1966 | Hanson | 36/71 X |
| 3,466,763 | 9/1969 | Levin | 36/69 X |

FOREIGN PATENT DOCUMENTS

| | | | |
|---|---|---|---|
| 2036062 | 2/1972 | Fed. Rep. of Germany | 36/129 |
| 404686 | 10/1909 | France | 36/37 |

*Primary Examiner*—James Kee Chi

*Attorney, Agent, or Firm*—Gregory J. Nelson

[57] ABSTRACT

A foot cushioning device having a body defining a cup-like recess to receive at least the heel or os calcis portion of the foot which is insertable in ordinary footwear. The exterior of the body carries shock absorbing projections extending from at least the rear of the heel portion to the underside of the foot. The projections deform and deflect to protect the foot by absorbing shock forces on the weight bearing portions of the foot. The cushioning device of the present invention may also be adapted to extend substantially along the entire plantar surface of the foot and may be integrally incorporated as a part of footwear.

8 Claims, 13 Drawing Figures

FOOT CUSHIONING DEVICE

The present invention relates generally to a foot appliance and more particularly relates to a cushioning and shock absorbing device which is insertable or may be incorporated in a shoe to relieve pressures on the weight bearing portions of the foot.

The anatomical structure of the foot is in the form of a tripod, the weight of the person is supported at the heel and at the head of the first and fifth metatarsal bones. Forces applied at these points are substantial and various conditions or disorders can arise as a result of the application of these forces. In physically active people and in many children and young adults, a vascular condition known as apophysitis can occur. Apophysitis is an inflamation of the tendon achilles at the point where the tendon joins the underside of the os calcis. Other disorders can be caused or aggravated by forces applied at the weight bearing portions of the foot. Such conditions include achilles tendonitis, formation of heel spurs and Osgood Shletters disease.

Various devices can be found in the prior art which are corrective foot appliances. Generally, these devices are orthopedic appliances to alleviate conditions such as flat footedness, or devices to maintain the heel and foot in the proper anatomical attitude to prevent the tendency of the foot to pronate. Typical of these devices are the appliances shown in the patent to Helfet, U.S. Pat. No. 2,821,032, which shows a one-piece, rigid appliance which is fitted to the heel of the foot. A somewhat similar device is disclosed in U.S. Pat. No. 3,545,447 to Silverman, showing a heel stabilizer insertable in a conventional shoe adapted to prevent pronation of the foot. A generally horseshoe-shaped element is bonded to the exterior of a heel receiving cup on the underside of the cup.

The prior art also shows various devices such as arch supports which are deformable and support the arch portion of the foot. These cushions generally incorporate a spongy or other elastic material in the arch portion of the support. Devices of this type are shown in U.S. Pat. Nos. 2,163,906 to Cote and 2,546,867 to Lavinthal.

The present invention provides a novel and unique cushioning device which includes a cup portion designed to fit over the heel of the wearer in the area of the os calcis. The medial and lateral sides of the cup conform the appliance to the heel seat of a shoe so the device can be inserted in any conventional shoe. The heel portion is formed from a relatively soft, flexible material such as a molded rubber or thermo plastic material. The exterior of the cup beneath the heel bone is provided with projecting shock absorbing members. The shock absorbing members may be formed in various configurations such as, semi-circular projections, disc-like projections or formed by a series of interconnecting longitudinal and transverse ribs. In other embodiments the cushioning device extends substantially along the entire plantar surface terminating in the general area of the metatarsal heads 1 through 5.

In other embodiments, the device may be formed as an integral portion of the insole and heel seat of a shoe. As pointed out above, the appliance can be used by individuals engaged in athletic endeavors such as joggers, runners, hikers, football players and the like. The appliance is particularly useful in preventing or alleviating apothysitis which is a common disorder in growing, active children. The device of the present invention is also extremely helpful in preventing vascular and other disorders in individuals who are required to stand for long periods on hard surfaces.

The above and other objects and advantages of the present invention will be more readily apparent from the following specification, claims and drawings in which:

Figure 9:
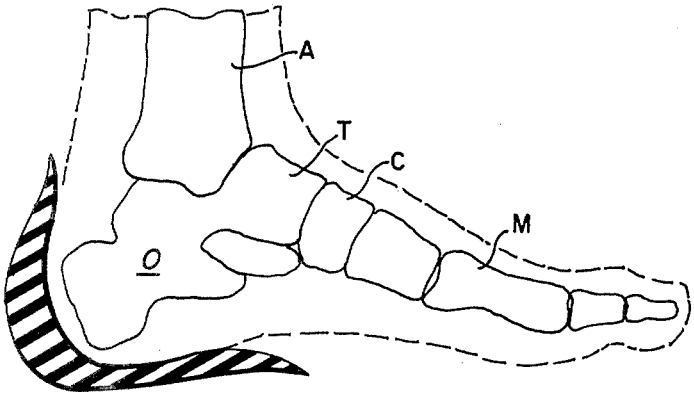
FIG. 9 is an elevational view showing the medial or inner side of the cushioning device of the present invention and its relationship with the bone structure of the foot applied to the foot of the wearer.

The skeletal structure of the human foot is shown in FIG. 9 and generally includes the os calcis or heel bone designated by the letter O. The talus T is positioned above the os calcis and below the tibia A. The forward bone structure of the foot includes the cuboid C and metatarsal bones M extending forwardly from the cuboid. Generally in the anatomically correct foot, the body weight is supported at three points; two weight bearing portions being on the forward part of the foot in the metatarsal area and the other weight bearing area being on the bottom of the foot below the os calcis. The tendon achilles extends along the rear of the foot and attaches to the underside of the os calcis. As discussed above, apothysitis which is an inflamatory response at the point where the tendon is attached to the bone is a common condition and can be caused or aggravated by shock and pressure forces particularly at the underside of the os calcis.

Figure 10:
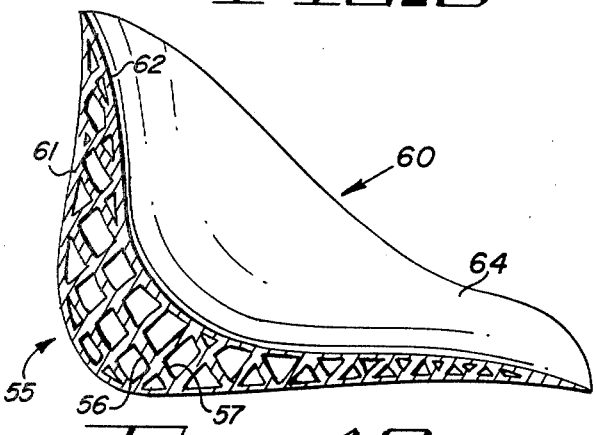
FIG. 10 is a longitudinal sectional view illustrating still another form of the cushioning device designed to fit on the heel portion of the foot.

The present invention relates to a cushioning or shock-absorbing device, the preferred embodiment of which is shown in FIGS. 1 to 3 and 9 and is generally designated by the numeral 10. Cushioning device 10 is designed to snugly fit about the os calcis as shown in FIG. 10 and is preferably molded as an integral piece from an appropriately lightweight material such as natural latex rubber, neoprene or a low density thermo plastic material, such as polypropylene or polyethylene. The materials of fabrication may vary but the main characteristics of the material is that the material should be resilient and have "memory" so that after the material is deformed, it returns to its original shape or position.

Figure 1:
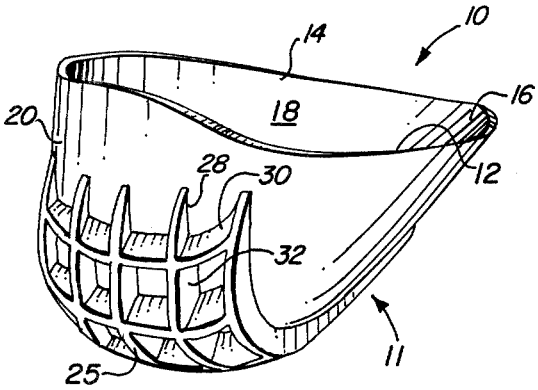
FIG. 1 is a perspective of the shock absorbing and cushioning device of the present invention designed to be secured about the heel of the user.
Figure 2:
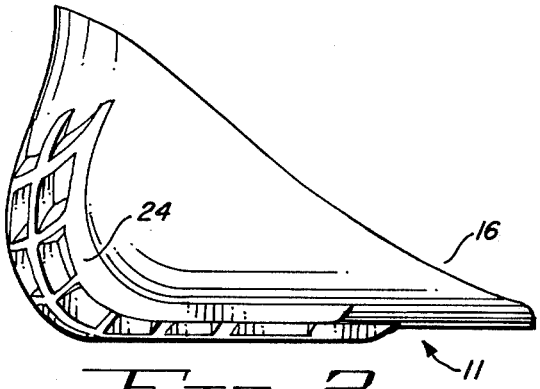
FIG. 2 is a side elevational view of the shock absorbing device shown in FIG. 1.
Figure 3:
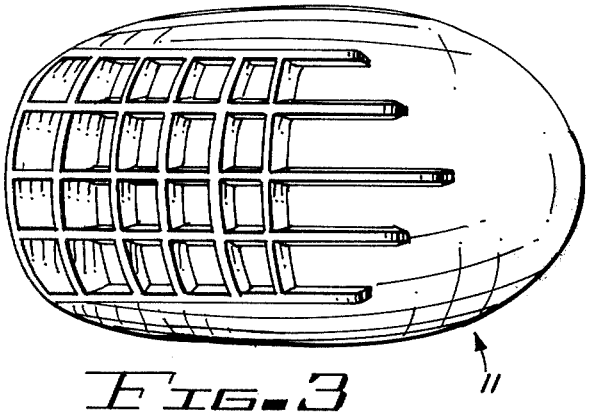
FIG. 3 is a view of the underside of the device shown in FIGS. 1 and 2.

The device 10 is formed from an integral body or cup 11 having opposite medial and lateral side walls 12 and 14 respectively. The side walls 12 and 14 are interconnected by a platform 16. A heel receiving recess 18 is completed by a generally vertical rear wall 20 which connects with platform 16 at curved heel seat 24. Shock absorbing or cushioning means 25 are provided to the exterior surface of the body 11. The shock absorbing means consist of a plurality of spaced-apart, parallel ribs 28 extending longitudinally along the exterior of rear wall 20 and continuing along the bottom side of platform 16. Preferably, as best seen in FIG. 2, the depth of the longitudinal rib decreases from a maximum depth in the area of the heel recess 24 to a minimum near the forward terminal end of the ribs. The number and spacing of the ribs may vary but the ribs should extend substantially the full width of the os calcis.

Transverse rib 30 intersects the longitudinal ribs 28 at spaced intervals forming a plurality of generally rectangular sections 32. With this configuration, the shock absorbing means 25 are in a general "waffle" configuration.

The heel cup 10 is placed in the heel section of a shoe and the wearer's foot inserted as shown in FIG. 9. Shock forces imparted during walking or other activities are absorbed by deflection or deformation of the ribs 28 and 30. After deflection, the ribs return to their normal, non-deflected state.

Figure 4:
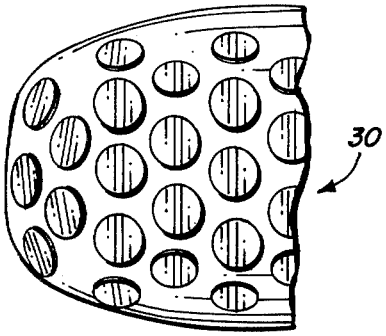
FIG. 4 is a partial bottom view showing another form of cushioning device.
Figure 5:
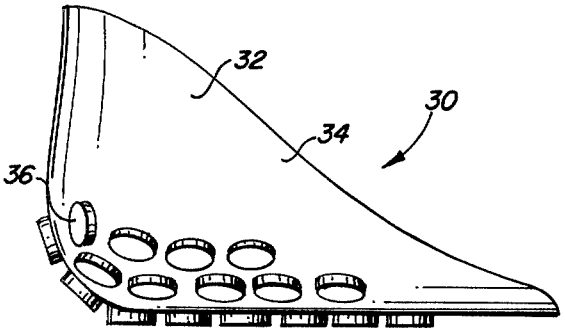
FIG. 5 is a side elevational view of the cushioning device as shown in FIG. 4.

FIGS. 4 and 5 illustrate another embodiment of the present invention generally designated by the numeral 30. In this embodiment, an integrally molded heel cup or body 32 is formed similar to that shown in FIGS. 1 to 3 having a central recess or cavity 34 for reception of the heel portion of the foot. The outside of the heel cup 32 carries a plurality of projections which are shown in the form of round, relatively thin discs of resilient material. The discs are located to extend from the exterior of the heel cup 32 in the area of the os calcis. Again, forces of shock imparted to the foot are absorbed by deflection and deformation of the shock absorbing members 36.

Figure 6:
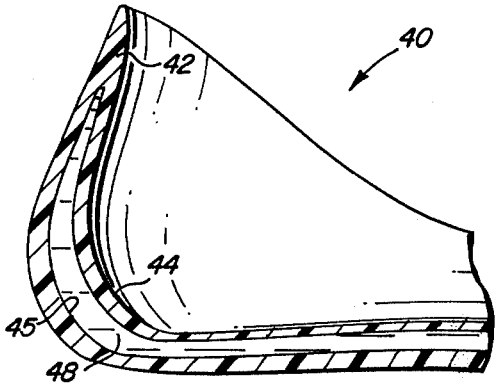
FIG. 6 is a longitudinal sectional view illustrating another form of a cushioning device in accordance with the present invention utilizing a liquid shock absorbing substance.

FIG. 6 shows still another embodiment of the present invention generally designated by the numeral 40 also including an integrally molded heel cup or body 42 defining a recess or cavity 44 for reception of the heel portion of the foot. An internal void or hollow section 45 is formed in the body of the heel cup extending from the rear of the cup to the underside in the area of the os calcis. The hollow cavity or void is filled with suitable liquid 48 for absorbing shock forces. The liquid 48 is preferably a viscous material such as a silicon gel which closely approximates the characteristics of fatty tissue in the foot and serves to absorb the shock forces imposed.

Figure 7:
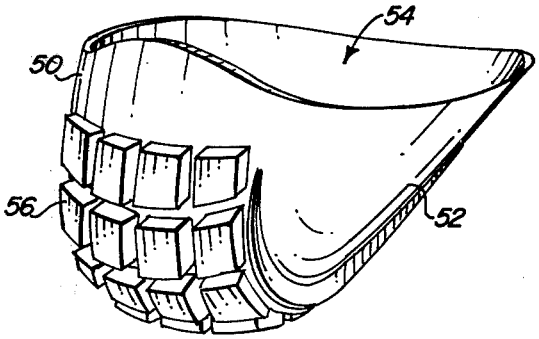
FIG. 7 is a perspective view illustrating still another form of the present invention.

FIG. 7 illustrates another form of the present invention generally designated by the numeral 50 generally including an integrally molded heel cup or body 52 defining a recess or cavity 54 for reception of the heel of the wearer. Projections 56 extend from the outer surface of the cup 52 and are in the form of generally rectangular members 36 which are resilient and spaced-apart extending laterally and longitudinally in the area corresponding to the os calcis.

Figure 8:
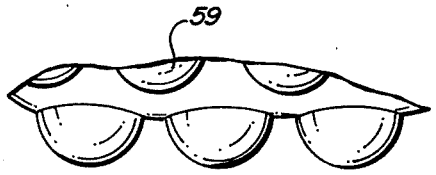
FIG. 8 is a fragmentary view showing still another form of the shock absorbing projections utilized with the present invention.

In FIG. 8, the shock absorbing projections 59 are slightly rounded to have a generally hemispherical shape and otherwise are functionally and structurally similar to those shown with reference to previous figures.

FIG. 10 illustrates still another embodiment of the present invention generally designated by the numeral 60. In this embodiment, an integrally formed cup or body 62 again is contoured to conform generally to the os calcis portion of the foot and defines a cavity or recess 64. Shock absorbing member 55 formed by a series of transversely extending ribs 56 and 57 which, as seen in FIG. 10 are angularly disposed on the exterior of cup 62 and intersect in a general X-configuration. An outer layer of material 61 covers the ribs 56 and 57 in a sandwich construction. Forces imposed on the user's heel are absorbed by the shock absorber 55 as ribs 56 and 57 will tend to deflect and distort under application of pressure to cushion the foot.

Figure 11:
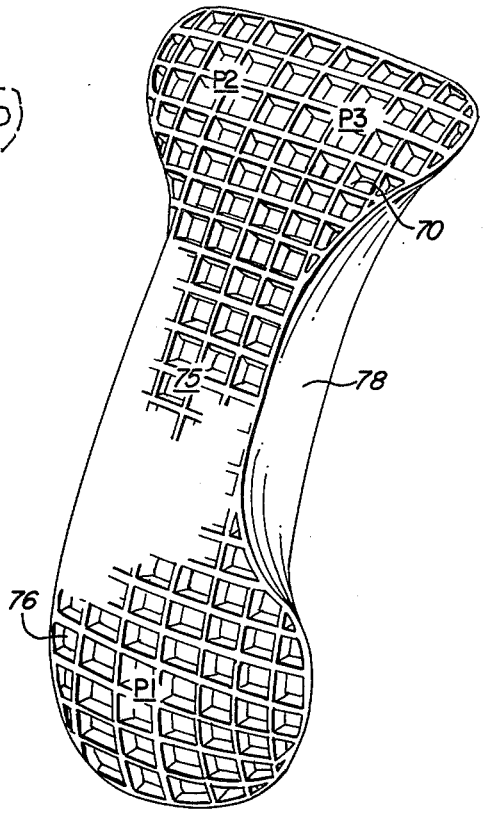
FIG. 11 is a bottom view illustrating another embodiment of the present invention designed to extend substantially over the entire plantar surface of the foot.
Figure 12:
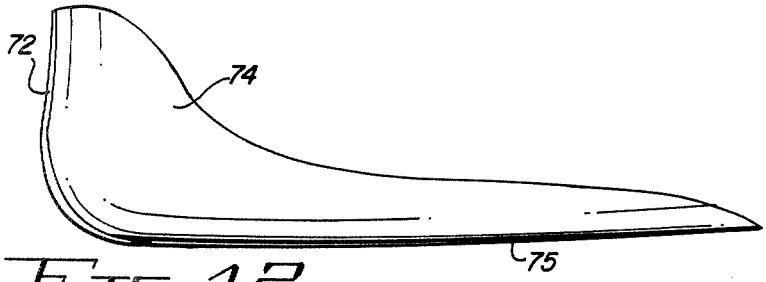
FIG. 12 is a side elevational view of the cushioning device shown in FIG. 11.

FIGS. 11 and 12 illustrate the modified form of the cushioning appliance of the present invention which is generally designated by the numeral 70. The cushioning device 70 includes a heel portion 72 having opposite sides 74 which engage the lateral and medial sides of the foot in the area of the os calcis.

Heel portion 72 extends around the os calcis and has a lower platform 75 which extends forwardly covering the plantar surface to an area approximately corresponding to the metatarsal heads 1 to 5. As discussed above, the weight of a person is supported generally at three points on the foot which are indicated as $P_1$, $P_2$, and $P_3$ in FIG. 11. The cushion device as shown in FIGS. 11 and 12 extends forwardly a sufficient distance to serve to absorb shock and forces imposed on the metatarsal area. Shock absorbing means 76 are provided along the entire underside of the platform and may be of the type described with reference to any of the preceeding Figures. For convenience of representation, the shock absorbing means are shown as longitudinal and transverse ribs 77 and 78 intersecting in a generally rectangular pattern. The arch area of the foot is generally elevated and cushioning in the area designated by numeral 78, which corresponds to the long medial arch, has not been included. The cushioning device 70 in other respects is substantially the same as that discussed with reference to prior drawings and figures. The cushioning device 70 is inserted in footwear and serves to absorb and dampen shock forces.

Figure 13:
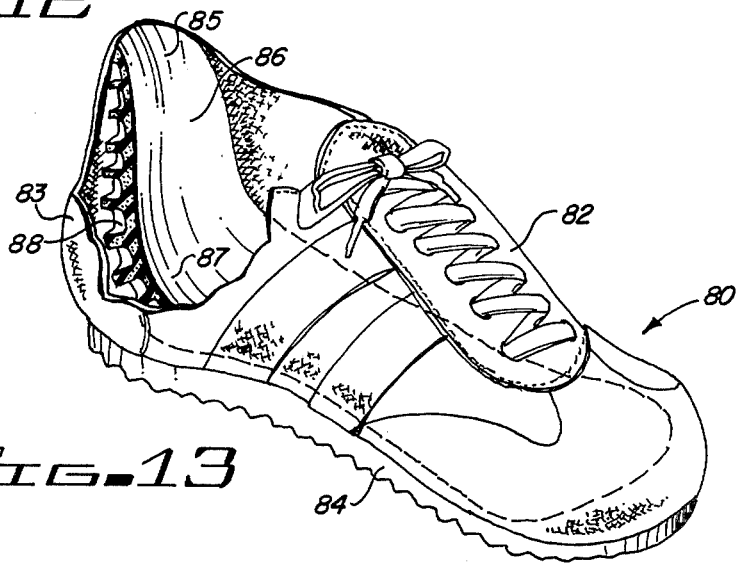
FIG. 13 is a perspective view of a shoe broken away showing the cushion as an integral part of the shoe.

FIG. 13 shows the present invention integrally formed into footwear 80. Shoe 80 can be of any type such as an athletic or jogging shoe and has an upper 82 and a lower sole 84 joined to the upper. In the heel sectiom 83 cushioning device 85 is integrally formed as part of the heel portion of the shoe. Cushioning device 85 again has a body or cup 86 defining a cavity or recess 87 for reception of the heel portion of the foot. The outer or exterior surface of the cushion is provided with shock absorbing or cushioning means 88 which can be of any configuration as described and is shown as having longitudinal and transverse ribs similar to those described with reference to FIGS. 1 to 3. It will be apparent that cushioning device similar to that as shown in FIGS. 11 and 12 having a platform extending substantially along the entire plantar surface of the foot may also be incorporated into ordinary footwear. The principal advantage of the inclusion of the cushioning device of the present invention for footwear is that cushioning means are affixed in place between the foot of the wearer and the hard sole of the shoe. Conventional shoe designs tend to alleviate shock-absorbing portions of the foot by use of specially designed soles having elevated heels such as are typical of jogging shoes or by providing specially formed ridges on the underside of the soles. Contrary to this approach, the present invention serves as a cushioning means between the foot and the interior sole surface thereby reducing shock forces imparted on the foot.

Thus, it will be seen that the present invention provides a simple, effective and unique cushioning device for the foot which is compatible with footwear of almost any type. The various forms of the shock absorbing means associated with the cushion body have been shown and it will be understood that the present invention is not limited to any particular shape or configuration. Those chosen were selected as being representative and for purposes of illustration only. Various materials can be used in the construction of the cushion of the present invention.

It will be apparent to those skilled in the art to make various changes, alterations and modifications to the present invention and to the extent that these changes, alterations and modifications do not depart from the spirit and scope of the appendant claims, they are intended to be encompassed therein.

I claim:

1. A foot cushioning device designed in view of the physiological and kinetic considerations of the foot comprising:

(a) a resilient body member having a medial side, a lateral side, bottom and rear walls defining a recess conforming to generally at least the os calcis portion of the foot, said rear wall adapted to extend along the plantar posterior portion of the heel to at least a location corresponding approximately to the vertical terminus of the os calcis;

(b) resilient shock absorbing means extending from the outer surface of said body member from a first end on the posterior plantar portion of the rear wall to the second end at a location on the bottom wall of said body member, said shock absorbing means having the greatest depth in the heel strike area and tapering to said bottom and rear walls at said first and second ends, said shock absorbing means further extending from said body at said lateral and medial side walls whereby forces imposed by heel strikes are absorbed by deflection and deformation and antipronatory motion is induced to relieve stresses placed on the foot and leg by deflection of said shock absorbing means and whereby upon release of said shock from said shock absorber means returns substantially to its normal position.

2. The foot cushioning device of claim 1 wherein said resilient body member and said shock absorbing means are formed as an integrally molded member.

3. The foot cushioning device of claim 1 wherein said shock absorbing means comprise first rib means disposed transversely on the outer surfaces of said body and second rib means disposed longitudinally on the outer surfaces of said body, said first and second rib means intersecting to define a "waffle" pattern.

4. The foot cushioning device of claim 1 wherein shock absorbing means comprise first rib means extending on the exterior surface of said body and disposed at an angle with respect to said body and second rib means extending on the exterior surface of said body disposed at an angle with respect to said body and intersecting said first rib means in a general decussate-shaped configuration when viewed in cross-section.

5. The foot cushioning device of claim 1 wherein said shock absorbing means comprise generally cylindrical projections extending from said body.

6. Foot cushioning device of claim 1 wherein said cushioning device is formed as an integral part of footwear.

7. The foot cushioning device of claim 1 wherein said body member and said shock absorbing means are integrally molded from latex rubber.

8. The foot cushioning device of claim 1 wherein said bottom wall extends a distance substantially conforming to plantar surface of the foot and terminating in the metatarsal area.

* * * * *